United States Patent [19]

Houseman

[11] 4,175,026

[45] Nov. 20, 1979

[54] ELECTROLYTIC APPARATUS FOR RECOVERING METAL FROM SOLUTIONS

[75] Inventor: Kenneth R. Houseman, St. Charles, Ill.

[73] Assignee: Litton Industrial Products, Inc., Beverly Hills, Calif.

[21] Appl. No.: 705,770

[22] Filed: Jul. 16, 1976

[51] Int. Cl.[2] ..... C25C 7/02; C25B 11/02; C25B 11/04

[52] U.S. Cl. ..... 204/272; 204/275; 204/289; 204/292; 204/294; 204/290 R

[58] Field of Search ..... 204/272, 290 R, 109, 204/275, 260, 273, 20, 289; 250/531-536

[56] References Cited

U.S. PATENT DOCUMENTS

| | | | |
|---|---|---|---|
| 3,223,608 | 12/1965 | Hersch | 204/272 X |
| 3,377,259 | 4/1968 | Phillips | 204/20 |
| 3,409,530 | 11/1968 | Locke et al. | 204/280 X |
| 3,637,482 | 1/1972 | Vajda | 204/290 R |
| 3,840,455 | 10/1974 | Cooley et al. | 204/109 X |
| 3,923,629 | 12/1975 | Shaffer | 204/260 |
| 3,953,313 | 4/1976 | Levenson | 204/109 X |
| 3,980,541 | 9/1976 | Aine | 204/290 R |

FOREIGN PATENT DOCUMENTS

| | | | |
|---|---|---|---|
| 916438 | 1/1963 | United Kingdom | 204/109 |

*Primary Examiner*—John H. Mack
*Assistant Examiner*—D. R. Valentine
*Attorney, Agent, or Firm*—Robert A. Seldon

[57] ABSTRACT

An electrolytic apparatus is disclosed for recovering a metal from a solution in which the metal is present in ionic form. In the preferred embodiment, the apparatus includes an elongated strip of plastic film coated on both sides thereof with conductive coatings to form anodic and cathodic surfaces. The film strip is located between two end plates to form a cell. The strip is formed into a spiral or helix so as to place the anodic surface opposite the cathodic surface. The cell is mounted within a canister and fluid passageways are provided to enable metal ion-containing solution to pass through the helical cell. Electrical leads are provided to equally distribute the plating current throughout the cell.

31 Claims, 13 Drawing Figures

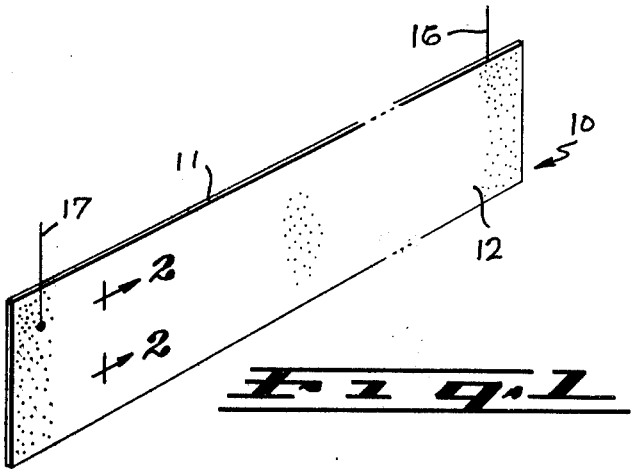
Fig. 1
Fig. 5
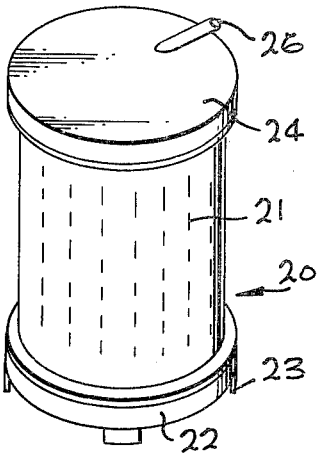
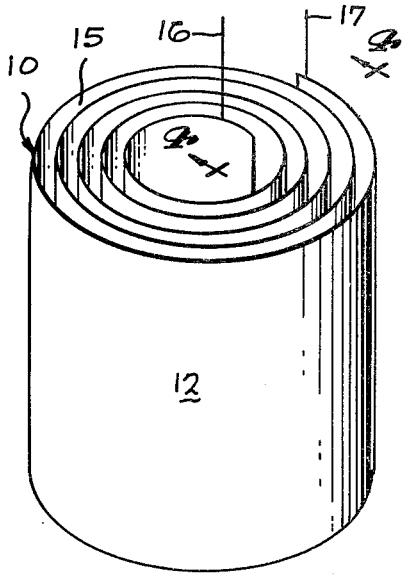
Fig. 3
Fig. 4
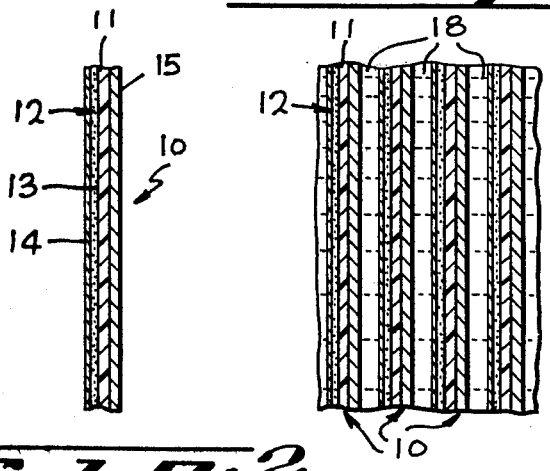
Fig. 2
Fig. 9
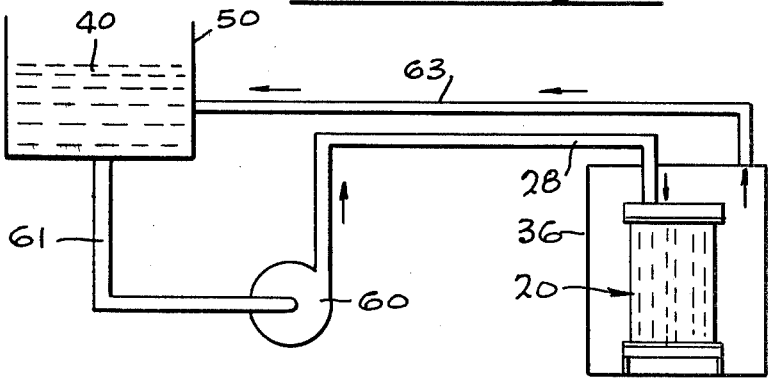

Fig. 10
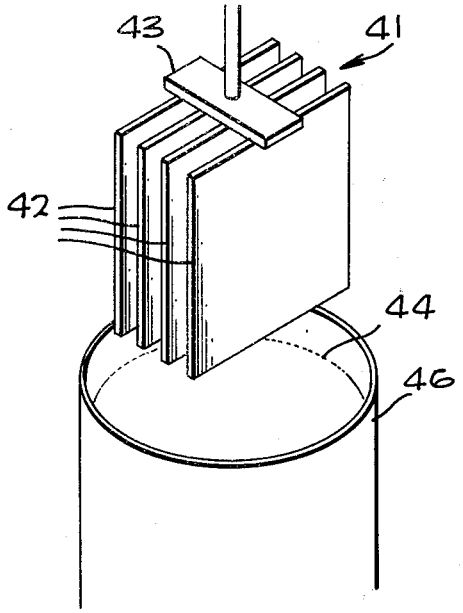
Fig. 11
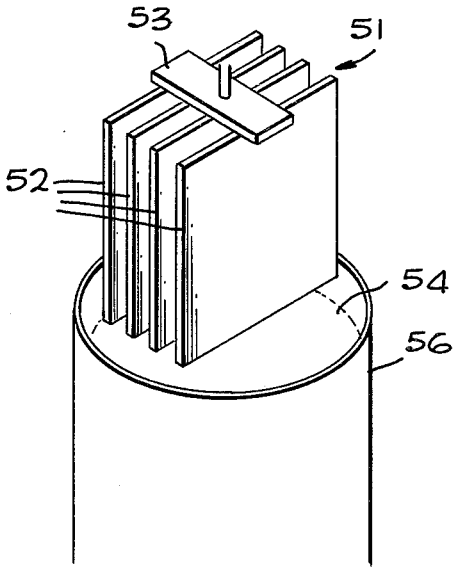
Fig. 12
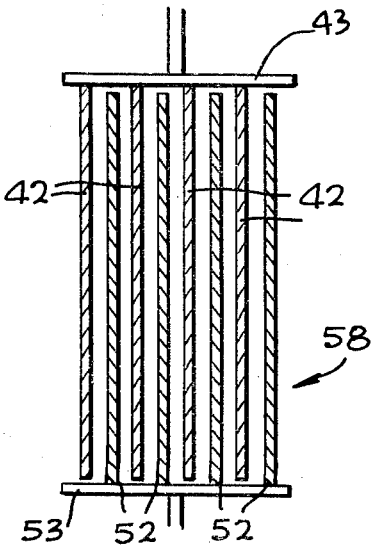
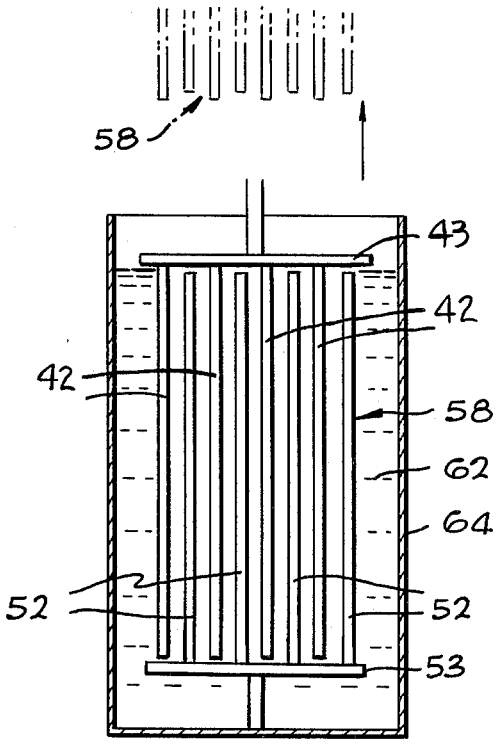
Fig. 13

ELECTROLYTIC APPARATUS FOR RECOVERING METAL FROM SOLUTIONS

BACKGROUND OF THE INVENTION

1. Field of the Invention

The present invention relates generally to electrolytic recovery of metals and more particularly to a novel electrolytic apparatus for recovering a metal from a solution containing ions of the metal. The apparatus of this invention is especially well suited for use with silver-laden solutions and is advantageously employed in recovering spent or recirculated silver from fixing solutions employed in photographic processing.

2. Description of the Prior Art

Methods for electrolytic recovery of metals are well known. Such methods usually involve immersing a pair of electrodes in the electrolytic solution and impressing across the electrodes a voltage of sufficient magnitude to effect migration of the metal ions to the cathode and deposition of the metal on the cathode surface in the form of a coherent plate which is subsequently removed. Electrolytic cells capable of accomplishing the desired recovery of metal have been developed in diverse forms embodying a variety of principles of operation and corresponding structural variations.

A shortcoming with a vast majority of these prior art systems is that the equipment is very expensive to manufacture. Moreover, the recovery process is cumbersome and costly, thereby combining to make the entire cost of recovery exorbitantly high.

Another shortcoming with previous systems is that relatively high current densities are necessary to ensure rapid and complete removal of metal ions. Such high current densities lead to poor physical form of the metallic plate, as well as degradation of the solution constituents.

The prior art patents uncovered in a patent search on the present invention are listed as follows:

| | |
|---|---|
| 583,255 | Georges |
| 2,834,724 | Mendes |
| 3,368,950 | Levine, et al. |
| 3,409,530 | Locke, et al. |
| 3,533,918 | Smith |
| 3,544,431 | Spoon |
| 3,551,317 | Cooley |
| 3,560,366 | Fisher |
| 3,655,547 | Lyons, Jr. |
| 3,661,756 | Spoon |
| 3,715,299 | Anderson, et al. |
| 3,759,813 | Raetzsch, et al. |
| 3,941,675 | Strasser, et al. |

SUMMARY OF THE INVENTION

The present invention obviates the above-mentioned shortcomings by providing an apparatus effective in recovering metals from a metal ion-containing solution that is simple in construction and operation, economical in manufacture, and capable of operating at relatively low current densities whether metal ions are present in high concentrations or not. The apparatus is therefore well suited for recirculation recovery of metal ions from baths where high current densities would preclude reuse of the bath itself.

In its broadest aspects, the present invention relates to an electrolytic apparatus for recovering a metal from a solution comprising one or more elongated strips of flexible insulating material coated on at least one side thereof with a conductive coating to form either an anodic or a cathodic surface.

In another aspect of the invention, the electrode comprises a single strip of insulating material having conducting coatings formed on both sides thereof to form anodic and cathodic surfaces. The strip of insulating material is oriented to form a spiral or helix so as to place the anodic planar surface opposite the cathodic planar surface.

In the preferred embodiment, the anodic surface is produced by depositing a highly conductive coating on the film surface as a substrate and subsequently coating the surface with a suitable conductive carbon graphite coating. The anodic planar surface could also utilize platinum, platinized titanium or tantalum. The cathodic surface is produced by depositing a suitable graphite, silver or other metal on the insulating strip surface. Non-metallic conductors can also be utilized to form the cathodic surface.

In a second embodiment, the electrolytic cell comprises a plurality of plates of insulating material coated with conductive material to form alternating anodic and cathodic planar surfaces.

The features of the present invention, which are believed to be novel, are set forth with particularity in the appended claims. The present invention, both as to its organization and manner of operation, together with the further advantages thereof, may best be understood by reference to the following description taken in connection with the accompanying drawings.

BRIEF DESCRIPTION OF THE DRAWINGS

FIG. 1 is a perspective view of a strip of insulating material coated on both sides thereof with conductive layers to form anodic and cathodic planar surfaces;

FIG. 2 is a fragmentary sectional view of the coated strip taken along lines 2—2 of FIG. 1;

FIG. 3 is a perspective view of the coated strip oriented in a helix to form electrodes;

FIG. 4 is a sectional view of the electrodes taken along lines 4—4 of FIG. 3;

FIG. 5 is a perspective view of an electrolytic cell utilizing the electrodes;

FIG. 9 is a schematic of the electrolytic cell utilized in a recovery system;

FIG. 10 is a perspective view of a second embodiment of the anode structure;

FIG. 11 is a perspective view of a second embodiment of the cathode structure;

FIG. 12 is a sectional view of the second embodiment of the electrolytic cell; and FIG. 13 is an elevational view of the electrolytic cell located in a container.

DESCRIPTION OF THE PREFERRED EMBODIMENT

Figure 6:
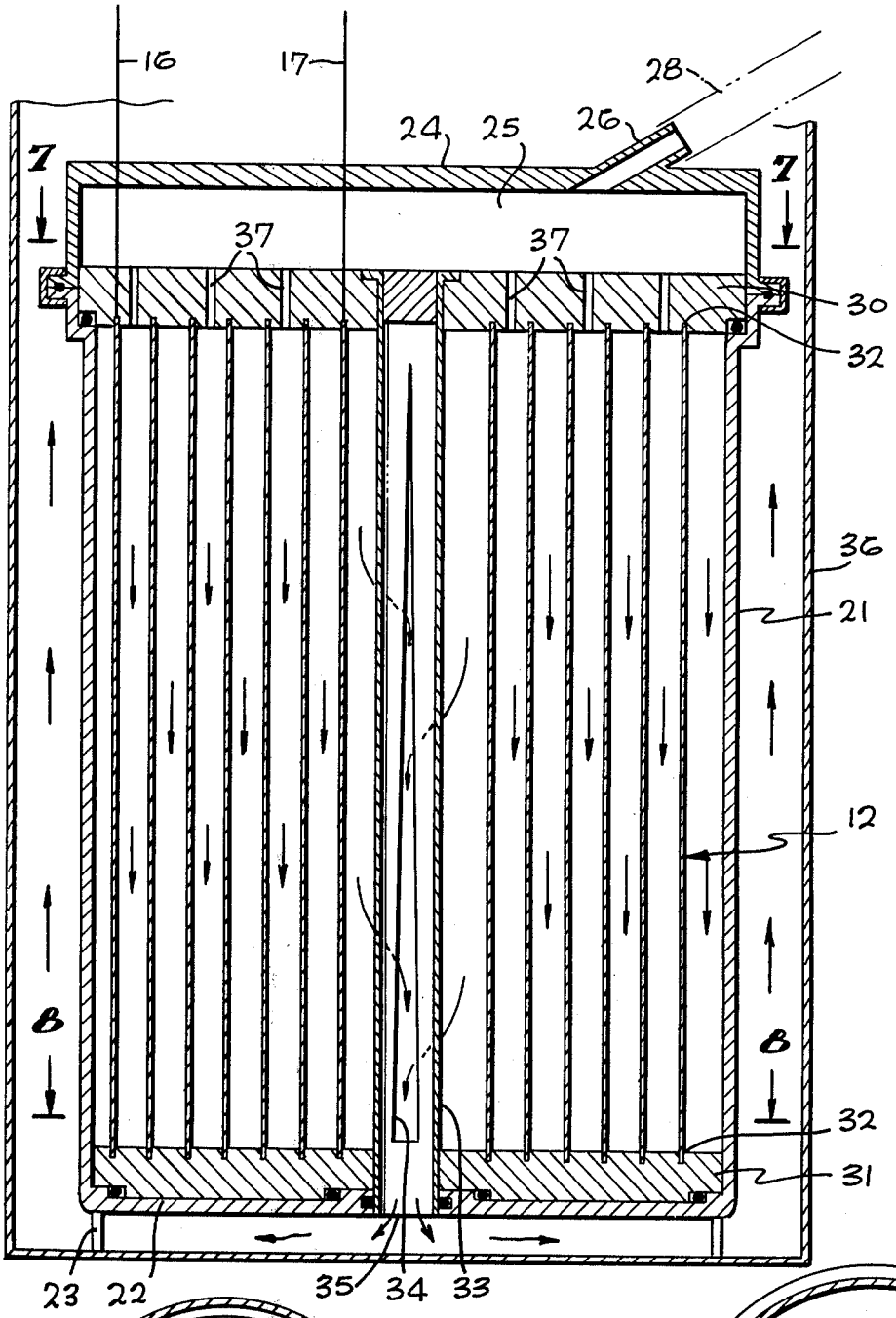
FIG. 6 is a sectional view of the electrolytic cell.

Referring now to the drawings, FIG. 1 illustrates an elongated strip generally indicated by arrow 10, which comprises a strip of insulating material 11, preferably made of a flexible material such as plastic. One side of the plastic strip 11 is coated with a film 12 of conductive non-sacrificing or non-oxidizing material forming an anodic surface. In the preferred embodiment, the anodic coating 12 comprises a substrate 13 of highly conductive material such as a resin bonded silver dispersion, and an overcoating 14 of resin bonded colloidal graphite dispersion. Other conductive non-sacrificing materials that can be used are carbon, platinized titanium or tantalum. The opposite side of the plastic strip 11 includes a second coating 15 of conductive material which forms a cathodic surface. The cathodic surface 15 is preferably made of silver or graphite. These particular layers 11, 12 and 15 are more clearly shown in FIG. 2.

FIG. 3 illustrates the elongated strip 10 being arranged in a helix. In this arrangement, the anodic surface 12 is oriented to face the cathodic surface 15 over substantially the entire length of the strip 11. Electrical leads 16 and 17 are electrically connected to the anodic and cathodic surfaces 12 and 15 respectively.

FIG. 4 clearly illustrates the arrangement of the alternating anodic and cathodic surfaces 12 and 15 facing each other. The area located between these surfaces is provided to contain a quantity 18 of fixer solution or any other fluid material containing ions of a metal.

FIG. 5 shows a canister generally indicated by arrow 20 utilized as the other housing for the electrolytic cell. The canister 20 includes a cylindrical wall 21, a bottom end 22 having legs 23 formed thereon, and a top cover 24 which further functions to partially form a plenum chamber 25 (see FIG. 6). The top cover 24 further includes an inlet port 26. FIG. 6 shows a conduit 28, illustrated in broken lines, which is adapted to be attached to the inlet port 26.

As also illustrated in FIG. 6, the electrolytic cell further includes upper and lower end plates 30 and 31 respectively, both of which include a helical groove 32 which functions to receive the upper and lower edges of the strip 10. A column 33 is also located between the end plates 30 and 31. The column 33 includes a triangular opening 34 to enable fluid located in the cell to pass therethrough. A discharge port 35 is provided at the base of the column 33 to enable the discharge fluid to pass therethrough into a container 36.

Figure 7:
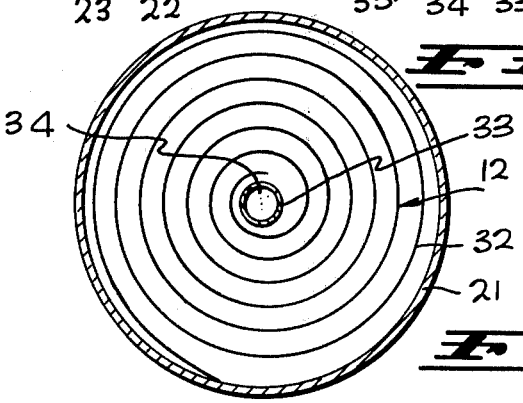
FIG. 7 is an elevational view partially in section of the cell's plenum chamber taken along lines 7—7 of FIG. 6.

The upper end plate 30 further includes a plurality of inlet ports 37 which are located on a bias and are oriented to allow the fluid passing through to enter the interior of the electrolytic cell in a swirling motion. The orientation of these inlet ports is more clearly illustrated in FIG. 7.

Figure 8:
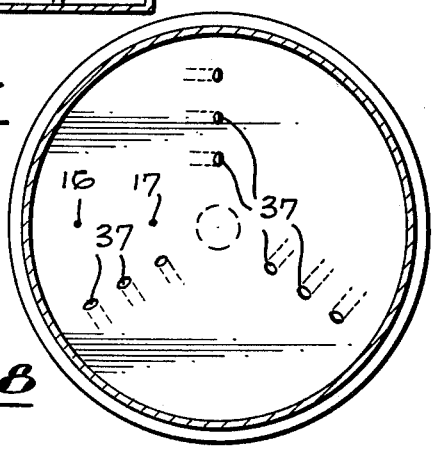
FIG. 8 is a sectional view of the electrolytic cell taken along lines 8—8 of FIG. 6.

FIG. 8 illustrates the cross section of the electrolytic cell having the strip 10 arranged in a helical configuration with the anodic and cathodic planar surfaces 15 and 16 to be fixed opposite each other.

As illustrated in FIG. 9, metal ion-containing solution 40 is stored in a large tank 50, which can be used as the tank of an automatic film processor. A port 51 is located at the bottom of the tank 50 to enable the solution 40 to communicate with the inlet of a pump 60. The pump 60 functions to draw the solution 40 from the tank 50 and pump it via the conduit 28 into the plenum chamber of the electrolytic cell 20.

As shown in FIG. 6, the solution then passes from the plenum chamber 25, through the ports 37 and enters the interior of the cell 10 in a swirling motion. Upon entering the interior of the cell 10, the solution 40 passes between the spaced anodic and cathodic planar surfaces 12 and 15. A voltage is then impressed across the electrodes through leads 16 and 17 in order to effect migration of the metal ions in the solution 40 to adhere to the cathodic surface 15. The solution 40 is then discharged through the column 33 into the container 36. The solution 40 finally passes from the container 36 back to the tank 50 via a conduit 52.

After the operation is complete, the canister 20 is then removed from the container 36, and the strip 10 is then removed from the cell with anodic surface 15 having the metal ions deposited thereon.

FIGS. 10 through 13 illustrate a second embodiment of an electrolytic cell generally indicated by arrow 58. The electrolytic cell 58 comprises an anode structure 41 and a cathode structure 51. The anode structure 41 comprises a mounting bar 43, having a plurality of parallel plates 42 mounted thereon. The plates 42 are preferably made of sheets of insulating material which is adapted to be coated with a conductive material. As shown in FIG. 10, the conductive material can be in the form of a solution 44 located in container 46 within which the plates 42 are deposited to enable the conductive solution to adhere to the plates 42 of the insulating material.

Similarly, the cathode structure 51 comprises a mounting bar 53, having a plurality of parallel plates 52 of insulating material mounted thereon. The plates 52 can also be coated by being immersed in a solution 54 of conductive material located in container 56 to enable the solution 54 to be coated thereon.

FIG. 12 illustrates an electrolytic cell 58 in which the anode structure 41 and the cathode structure 51 are oriented such that the sheets 42 of the anode 41 are alternatively displaced between the sheets 52 of the cathode 51.

As shown in FIG. 13, the electrolytic cell 58, comprising the alternating anodic and cathodic surfaces 42 and 52 respectively, are immersed in a fixer solution 62 contained within a canister 64. Electrical leads, not shown, are provided to impress across the electrodes a voltage of sufficient magnitude to effect the migration of the metal ions to the cathodic surfaces 52. Although not shown, the canister 64 can be continuously replenished as shown in the system as illustrated in FIG. 9.

It should be noted that various modifications can be made to the assembly while still remaining within the purview of the following claims. For example, the electrode structure of the present invention can be utilized for other purposes than those specifically described in the specification.

What is claimed is:

1. An electrolytic apparatus for recovering a metal from a solution containing ions of the metal, said apparatus comprising:

a cell including a sheet of insulating material having a first coating of conductive material located on one side thereof to form a cathodic surface and a second coating on the other side thereof to form an anodic surface;

means for impressing a voltage between said anodic and cathodic surfaces: and means for passing the metal ion-containing fluid through said cell and across said surfaces.

2. The apparatus of claim 1 wherein said sheet of insulating material is sufficiently flexible to permit at least a portion of its sides to be oriented into a face to face relationship.

3. The apparatus of claim 1 wherein at least a portion of the sides of said sheet of insulating material are mutually oriented to enable said anodic and cathodic surfaces to face each other.

4. The apparatus of claim 3 wherein said sheet of insulating material is oriented to form a helix or spiral.

5. The apparatus of claim 1 wherein said cell is located within a canister adapted to contain a fluid.

6. The apparatus of claim 1 wherein said cell further includes a pair of end plates having said sheet of insulating material located therebetween.

7. The apparatus of claim 6 wherein said end plates have helical or spiral grooves formed therein to receive the edges of said sheet of insulating film.

8. The apparatus of claim 7, wherein the end plates are vertically spaced from each other, the cell includes a plenum chamber located above the upper end plate and a plurality of inlet ports formed on said upper plate communicate with the plenum chamber and with the electrodes.

9. The apparatus of claim 8 wherein said inlet ports are radially spaced across the upper end plate.

10. The apparatus of claim 8 further including an outlet port on the bottom plate for permitting egress of fluid.

11. The apparatus of claim 1 wherein said sheet of flexible insulating material is plastic.

12. The apparatus of claim 1 wherein said anodic coating material is non-sacrificing.

13. The apparatus of claim 12 wherein said anodic coating material is selected from a group of metals consisting of platinum, platinized titanium or tantalum.

14. The apparatus of claim 12 wherein said anodic coating material is carbon.

15. The apparatus of claim 1 wherein said cathodic coating material is selected from a group consisting of silver or graphite.

16. The apparatus of claim 1 wherein said anodic surface comprises a substrate of highly conductive material and a top layer of carbon graphite.

17. The apparatus of claim 1 wherein said cell comprises a plurality of parallel planar sheets of insulating material having coatings of conductive materials located thereon forming a plurality of anodic surfaces.

18. The apparatus of claim 17 wherein said cell further comprises a second plurality of parallel planar sheets of insulating material having coatings of conductive materials located thereon forming a plurality of cathodic surfaces.

19. The apparatus of claim 18 wherein said first and second plurality of parallel planar sheets are oriented to enable said plurality of anodic and cathodic surfaces to be alternately facing each other.

20. An electrode for an electrolytic apparatus comprising a sheet of insulating material having a first electrically conductive coating on one side thereof and a second electrically conductive coating on the other side thereof, at least a portion of said one side being oriented with respect to at least a portion of said other side so that the first and second coatings are in a mutually spaced-apart facing relationship to form an integral electrode pair.

21. The electrode of claim 20 wherein the insulating sheet is wound in a generally helical shape so that the respectively coated surfaces are mutually opposing and spaced apart over substantially the entire area of the sheet.

22. The electrode of claim 21 wherein one of the coatings is formed from an electrically conductive substrate and a nonsacrificing overcoat of electrically conductive material, the electrical conductivity of the substrate being substantially greater than the electrical conductivity of the overcoat.

23. An electrode for an electrolytic apparatus comprising;

a substrate of electrically insulative material;

an overcoating of electrically conductive and nonsacrificing electrode material a highly electrically conductive coating interjacent the substrate and overcoating and electrically coupled to the overcoating; and terminal means for coupling a source of electricity to the interjacent coating.

24. The electrode of claim 23 wherein the substrate is a sheet.

25. The electrode of claim 24 wherein the substrate is sufficiently bendable to undergo generally circular deformation.

26. The electrode of claim 24 wherein the substrate is plastic.

27. The electrode of claim 23 wherein the overcoating is a film.

28. The electrode of claim 23 wherein the interjacent coating is a film.

29. The electrode of claim 23 wherein the interjacent coating is formed on the substrate surface and the overcoating is formed on the interjacent coating surface.

30. The electrode of claim 23 wherein the interjacent coating is formed from silver.

31. The electrode of claim 23 wherein the overcoating is formed from graphite.

* * * * *